US005111042A

United States Patent [19]

Sullivan et al.

[11] Patent Number: 5,111,042

[45] Date of Patent: May 5, 1992

[54] METHOD AND APPARATUS FOR GENERATING PARTICLE BEAMS

[75] Inventors: John L. Sullivan, Stourbridge; Ning-Sheng Xu, Birmingham, both of England

[73] Assignee: National Research Development Corp., London, England

[21] Appl. No.: 469,481

[22] PCT Filed: Oct. 28, 1988

[86] PCT No.: PCT/GB88/00938

§ 371 Date: Apr. 11, 1990

§ 102(e) Date: Apr. 11, 1990

[87] PCT Pub. No.: WO89/04586

PCT Pub. Date: May 18, 1989

[30] Foreign Application Priority Data

Oct. 30, 1987 [GB] United Kingdom ..... 8725459

[51] Int. Cl.[5] ..... H05H 3/00

[52] U.S. Cl. ..... 250/251

[58] Field of Search ..... 250/251, 281, 288, 427

[56] References Cited

U.S. PATENT DOCUMENTS

| | | | |
|---|---|---|---|
| 3,424,904 | 1/1969 | Donnally | 250/251 |
| 3,665,182 | 5/1972 | Goff et al. . | |
| 3,757,114 | 9/1973 | Simms et al. | 250/251 |
| 4,090,077 | 5/1978 | Anger | 250/311 |
| 4,261,698 | 4/1981 | Carr et al. . | |

FOREIGN PATENT DOCUMENTS

| | | |
|---|---|---|
| 3130276 | 2/1983 | Fed. Rep. of Germany . |
| 2212044 | 7/1974 | France . |

OTHER PUBLICATIONS

"Differential Scattering of Metastable He(2 $^3$S) on He(1 $^1$S) at Energies between 5-10 eV", Morgenstern et al., *Physical Review A,* vol. 8, No. 5, Nov. 1973, pp. 2372-2379.

"Low energy H atom analyzer using a cesium heat pipe", Brisson et al., *Rev. of Sci. Inst.,* vol. 51, No. 4, Apr. 1980, pp. 511-515.

Review of Scientific Instruments, vol. 56, No. 8, Aug. 1985, P. M. Thompson et al, pp. 1557-1563.

Nuclear Instruments and Methods, vol. 149, 1978, North-Holland Publishing Co., (Ansterdam, NL) C. W. Magee et al, pp. 529-533.

Journal of Vacuum Science & Technology/B, vol. 3, No. 1, Second Series, Jan./Feb. 1985, H. Paik et al, pp. 75-81.

Japanese Journal of Applied Physics, vol. 5, No. 6, Jun. 1966, (Tokyo, Japan) K. Morita et al, pp. 511-518.

Instruments and Experimental Techniques, vol. 23, No. 3, Part 2, May-Jun. 1981, E. N. Evlanov et al. p. 734.

Anal. Chem., vol. 59, No. 13, Jul. 1987, A. D. Appelhans et al., pp. 1685-1691.

*Primary Examiner*—Bruce C. Anderson

[57] ABSTRACT

A source of atomic or molecular particles includes a source of ionized particles (1), an extraction electrode (2) and an einzel lens (3) to focus a beam of particles. A Wien filter (4) selects particles in said beam having a predetermined velocity and a charge exchange cell (7) neutralizes the ionized particles prior to the extraction of non-ionized particles from the beam.

25 Claims, 17 Drawing Sheets

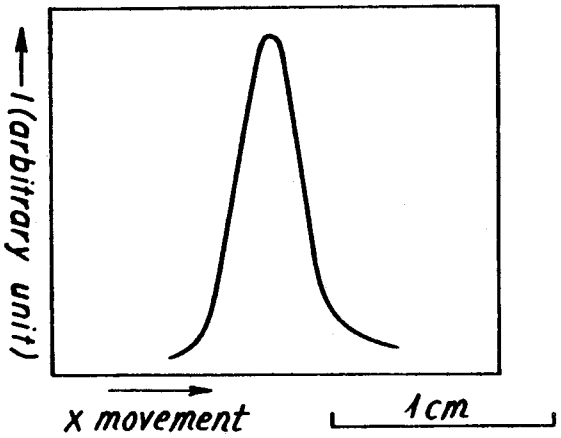
Fig. 9
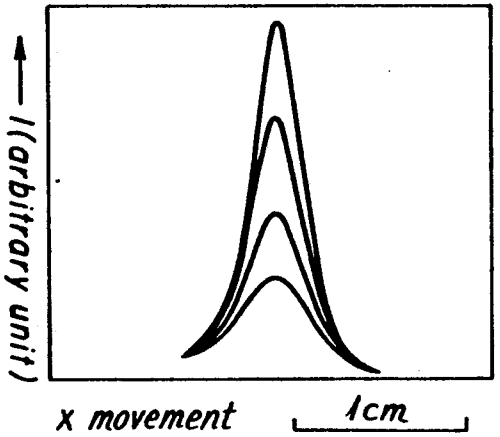
Fig. 11 Typical example showing current distribution of different energy atom beams.
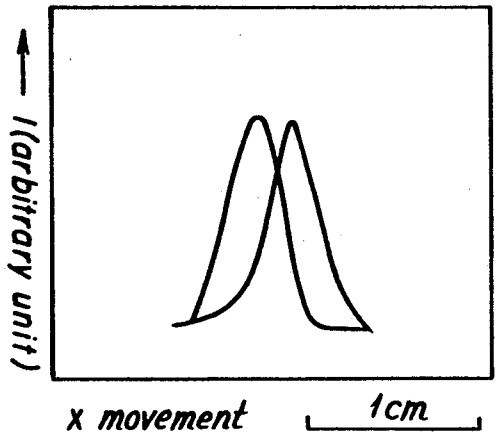
Fig. 10 A typical example showing displacement of total beam from atom beam.

Schematic diagram of the electronic system for the TOF facility.

METHOD AND APPARATUS FOR GENERATING PARTICLE BEAMS

The invention relates to apparatus for generating atomic beams. With increasing demand for fast atom applications for surface analysis and other studies, a pulsed fast atom source is urgently needed. For example, in instruments employing time-of-flight techniques and using fast atoms as their incident projectile a pulsed fast atom source is essential. According to the present invention there is provided a source of atomic or molecular particles comprising a source of ionized particles, means to remove a beam of said particles from said source, focusing means to focus said beam of particles and filter means to select particles in said beam having a predetermined velocity.

An embodiment of the invention will now be described by way of example with reference to the accompanying drawings in which.

Figure 4:
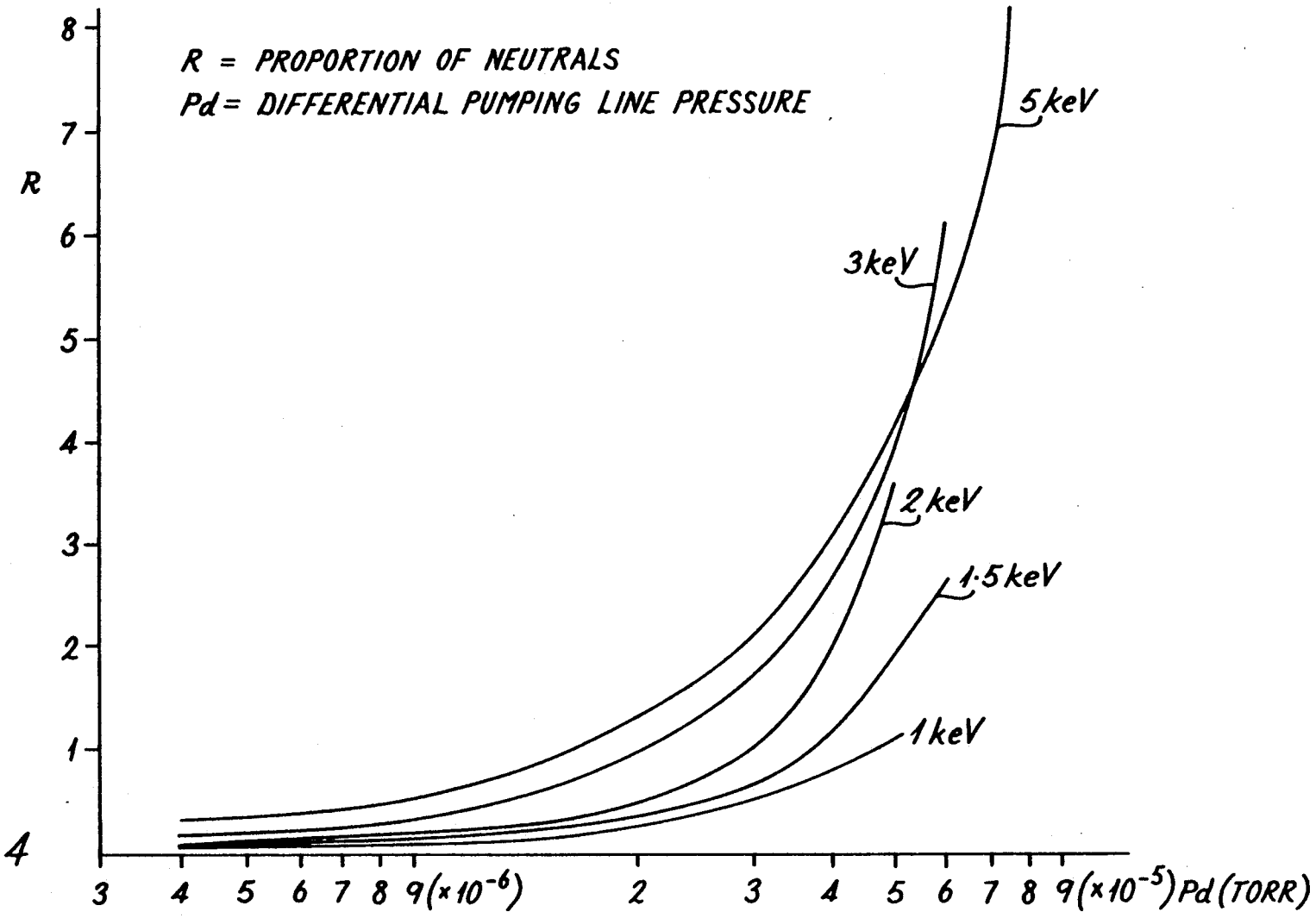
Figure 5:
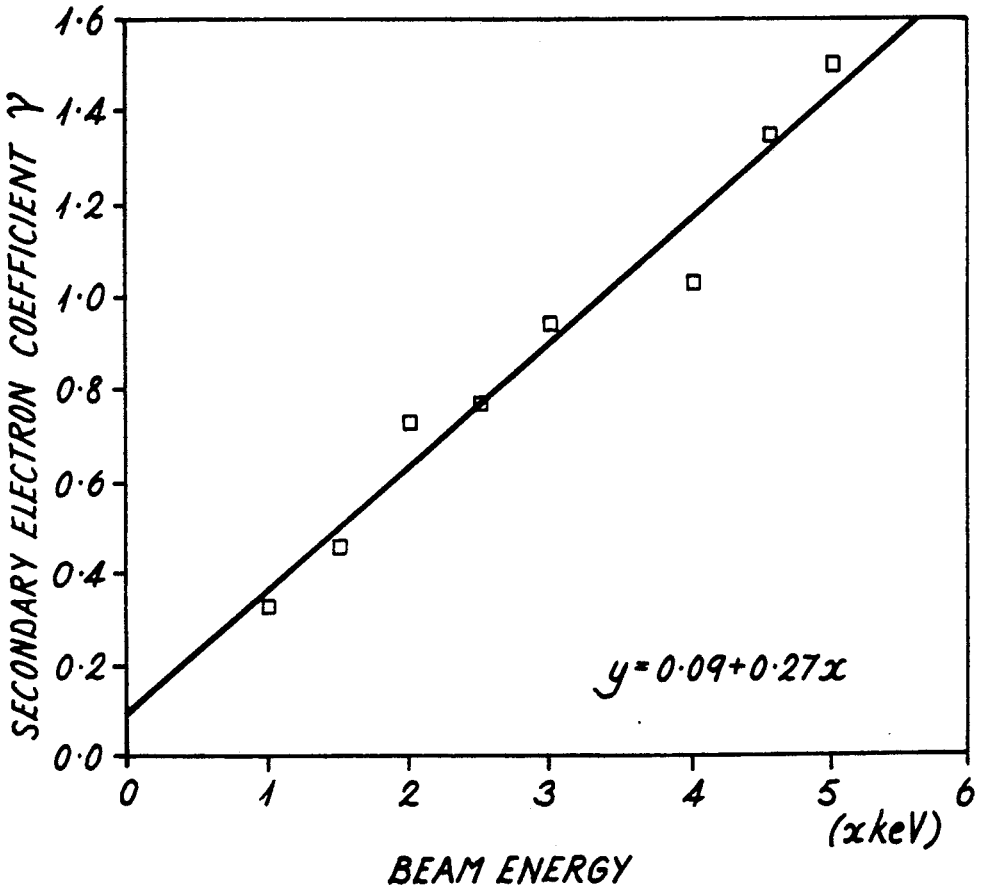
Figure 6:
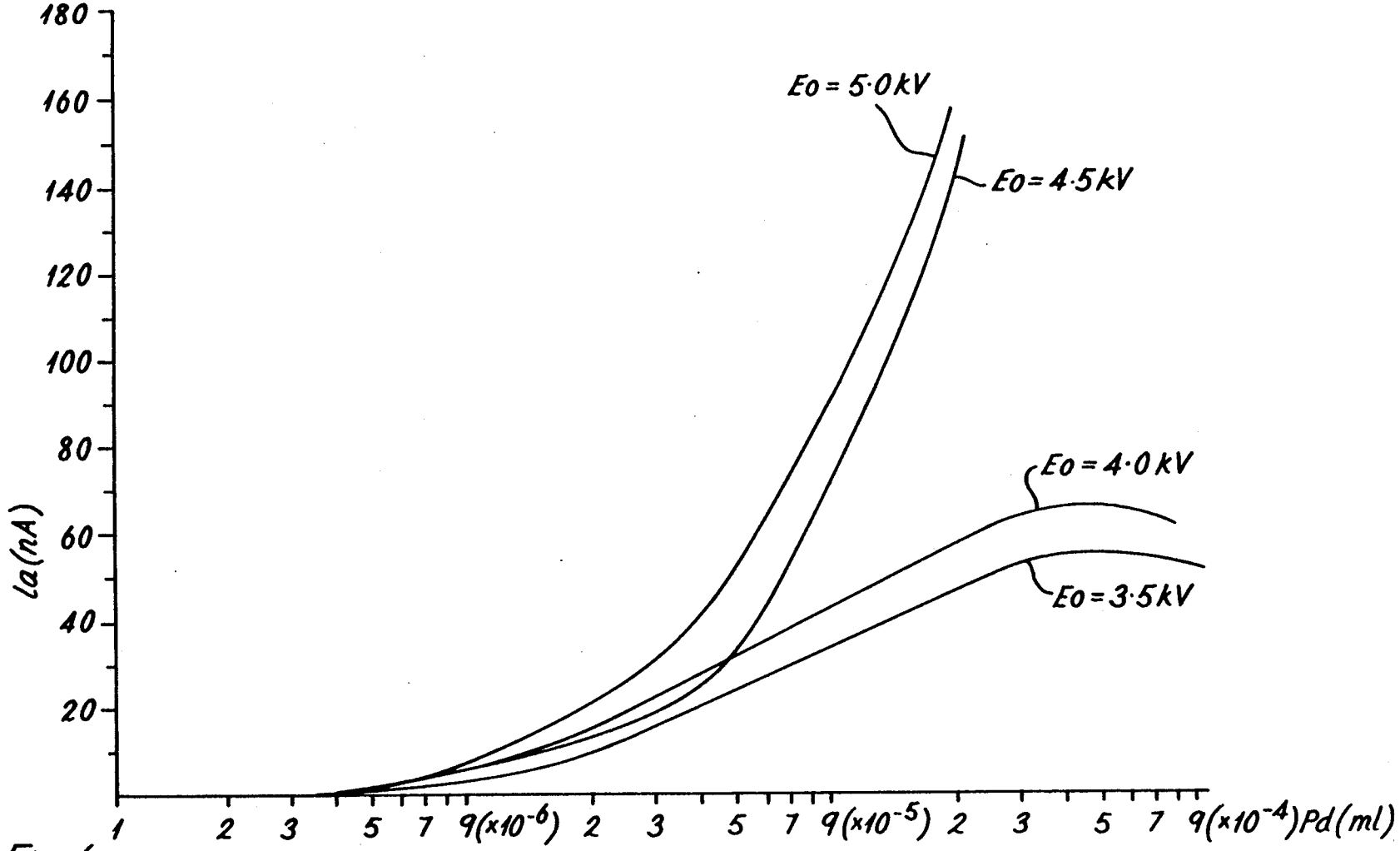
Figure 7:
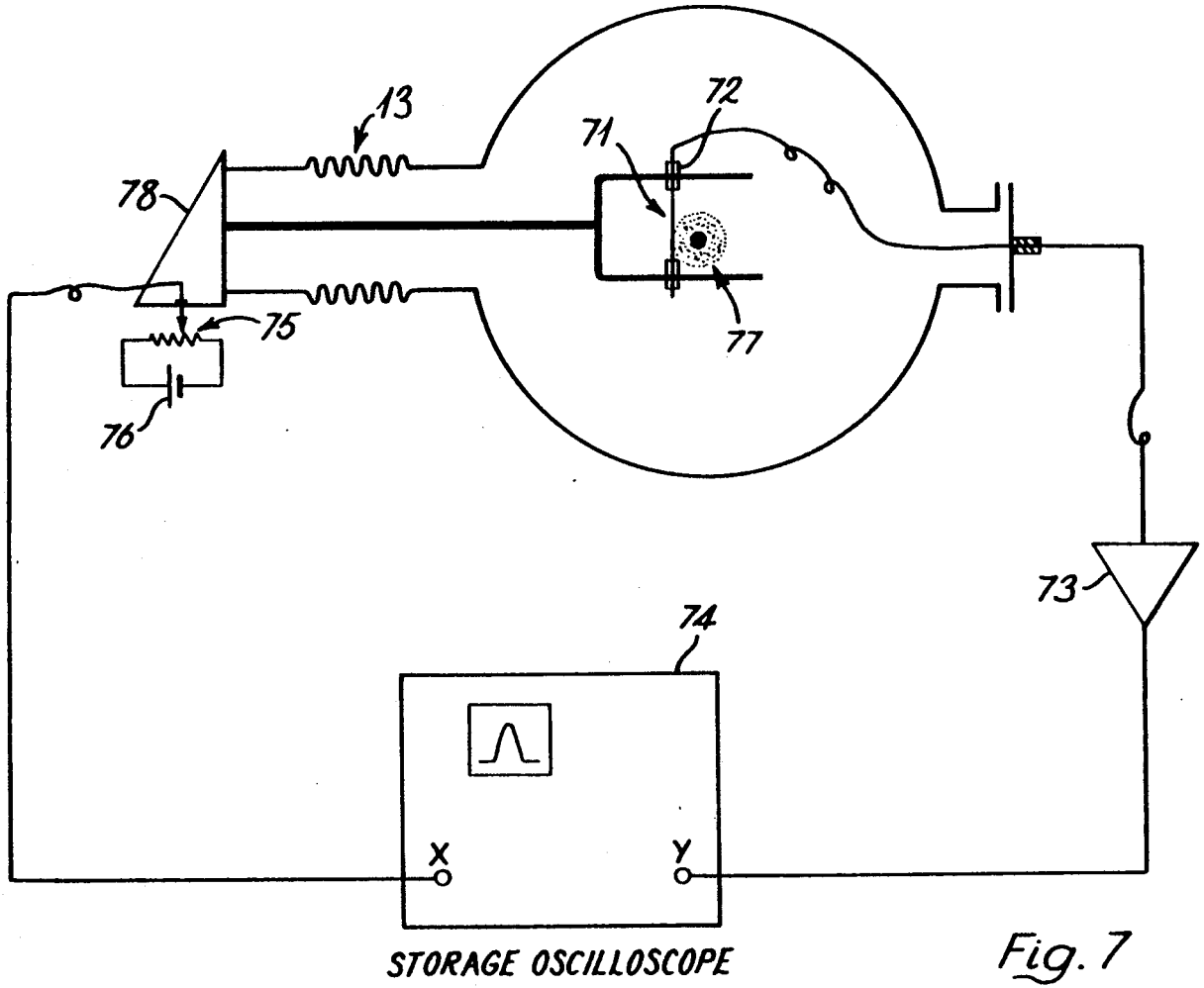
Figure 8:
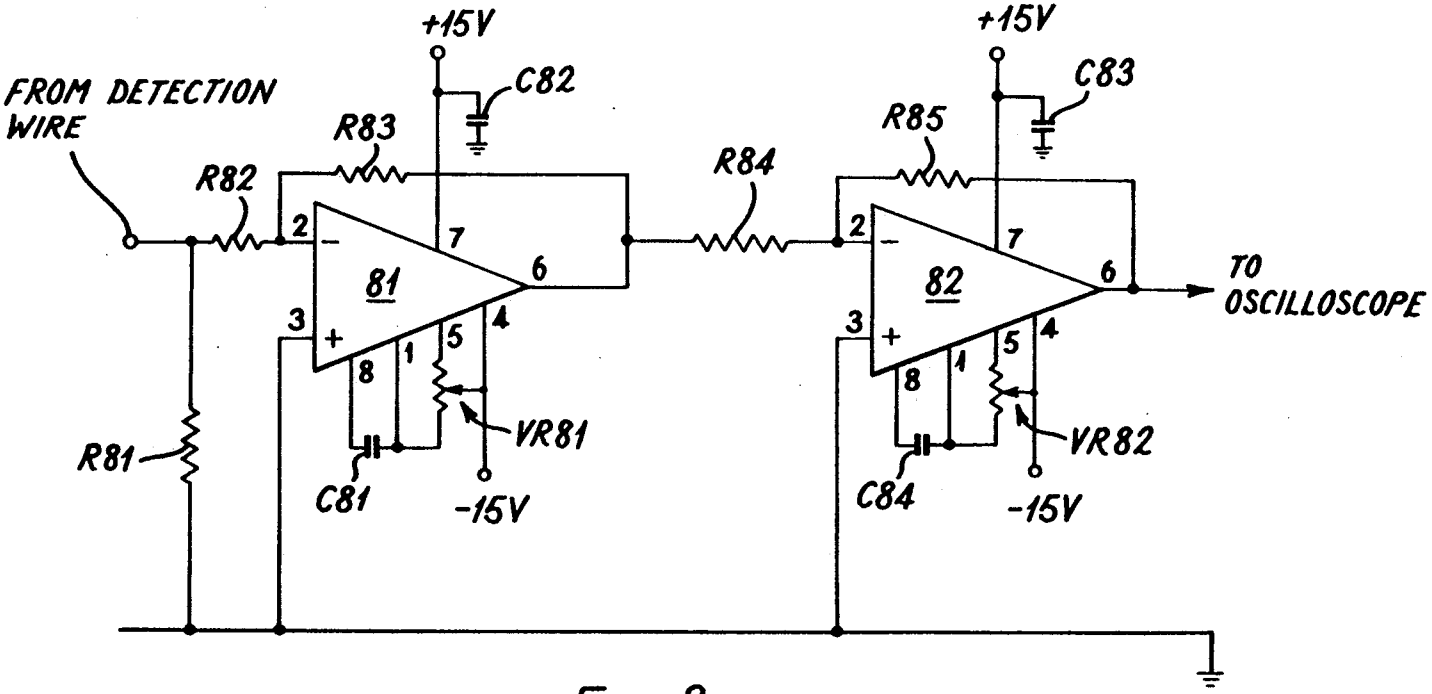
Figure 12B:
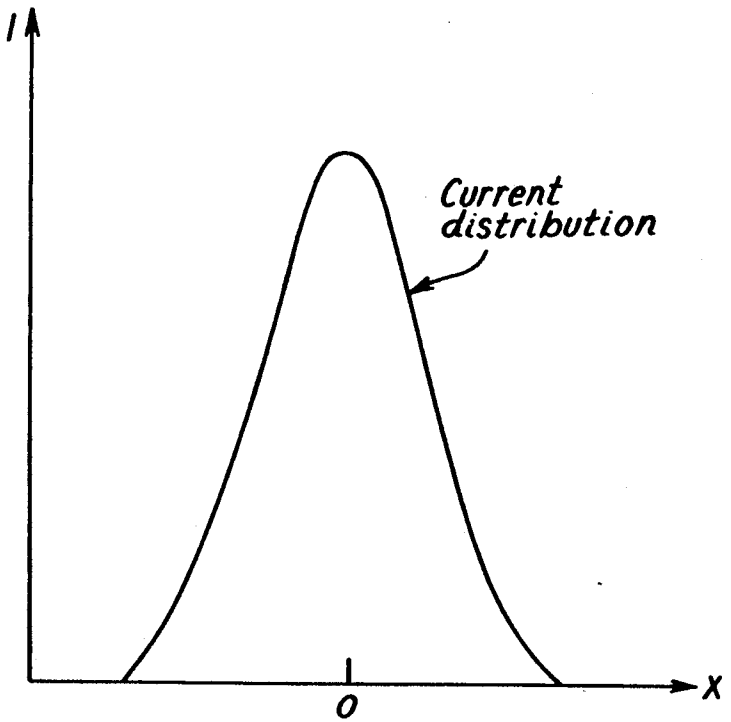
Figure 12A:
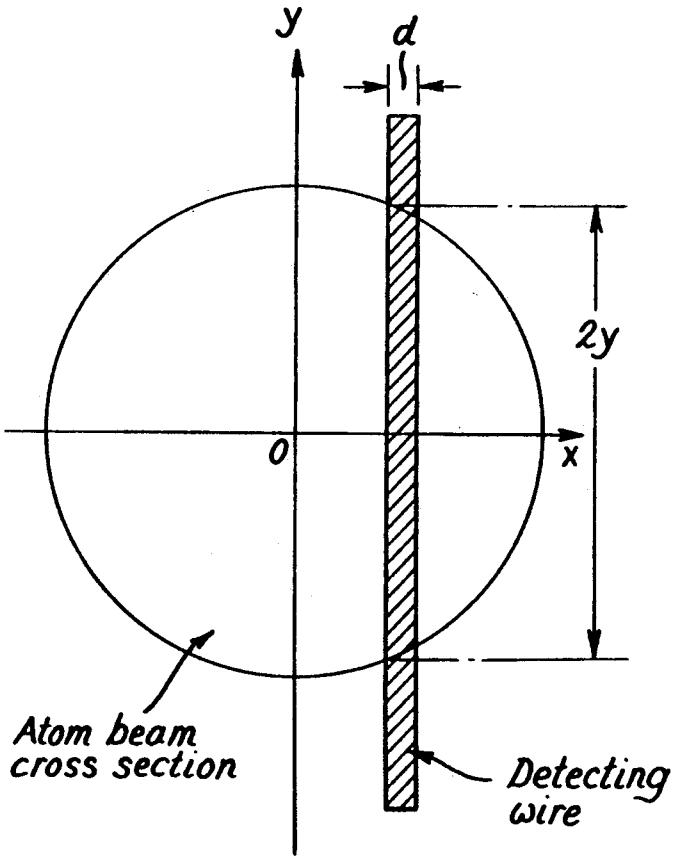
Figure 13:
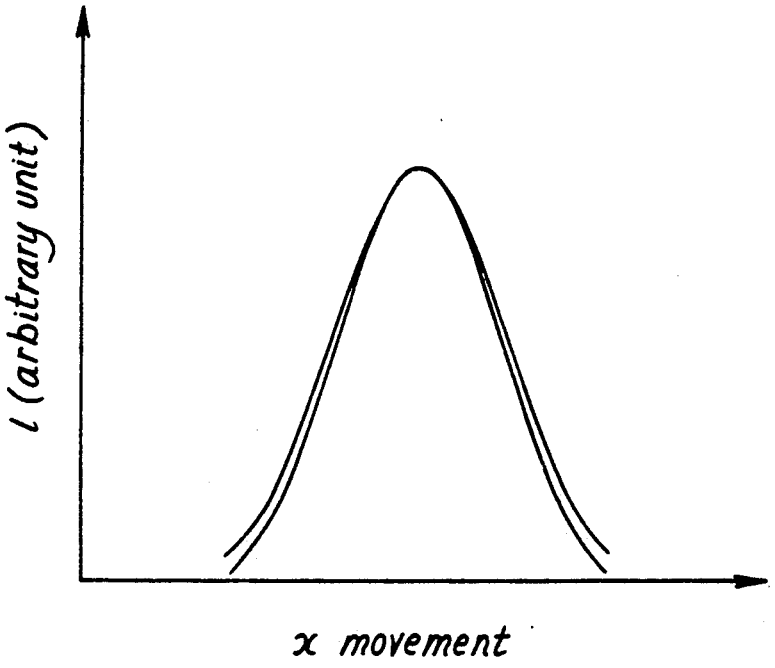
Figure 14:
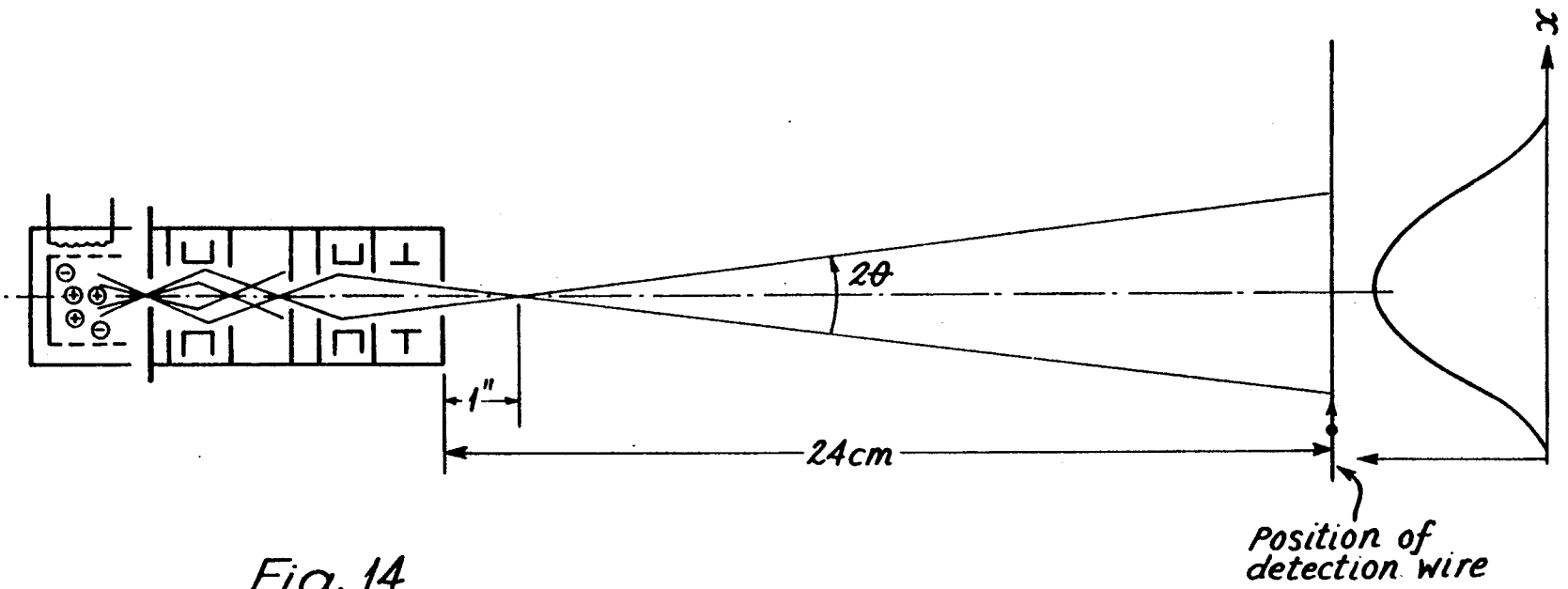
Figure 15:
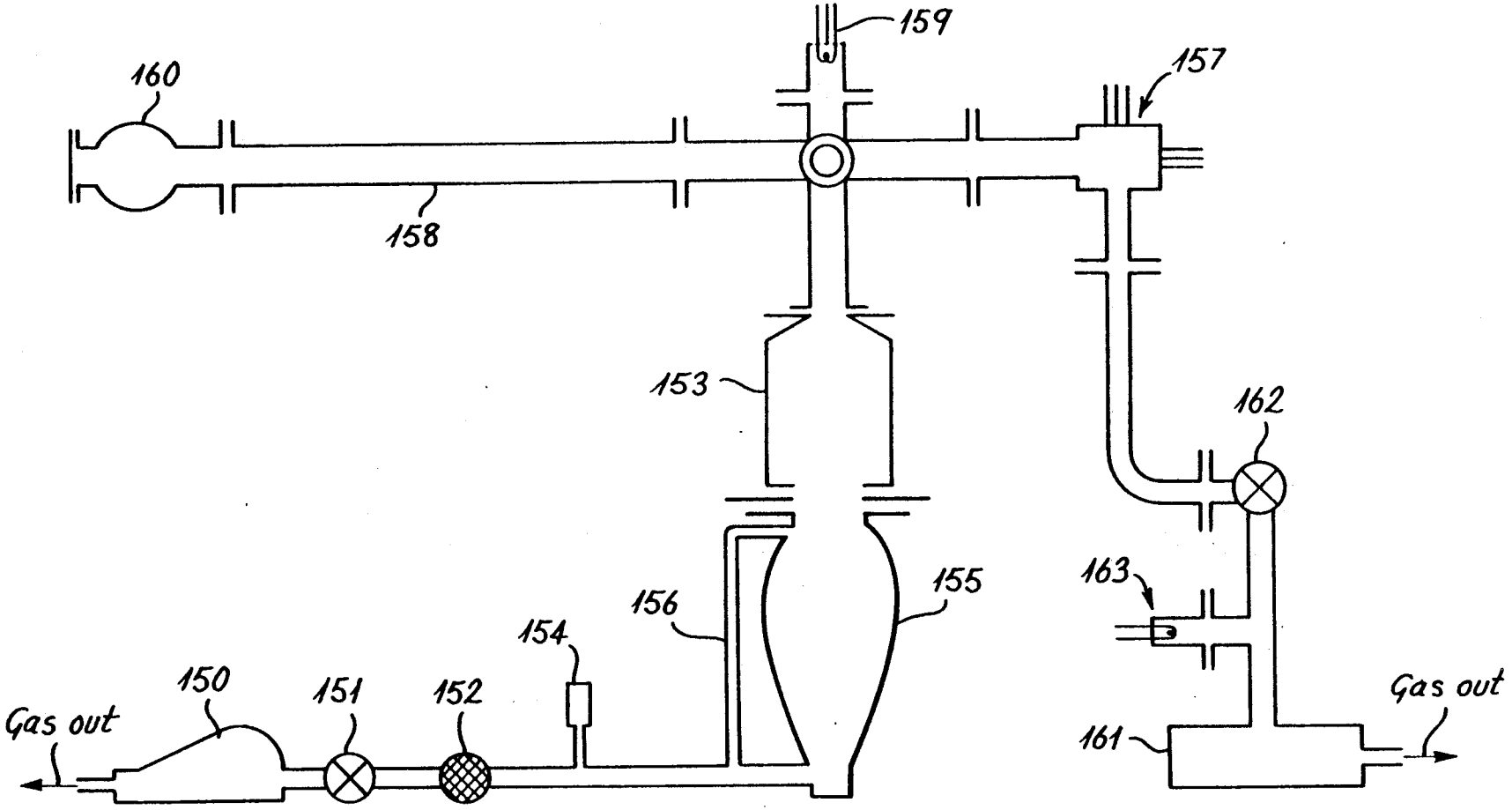
Figure 16:
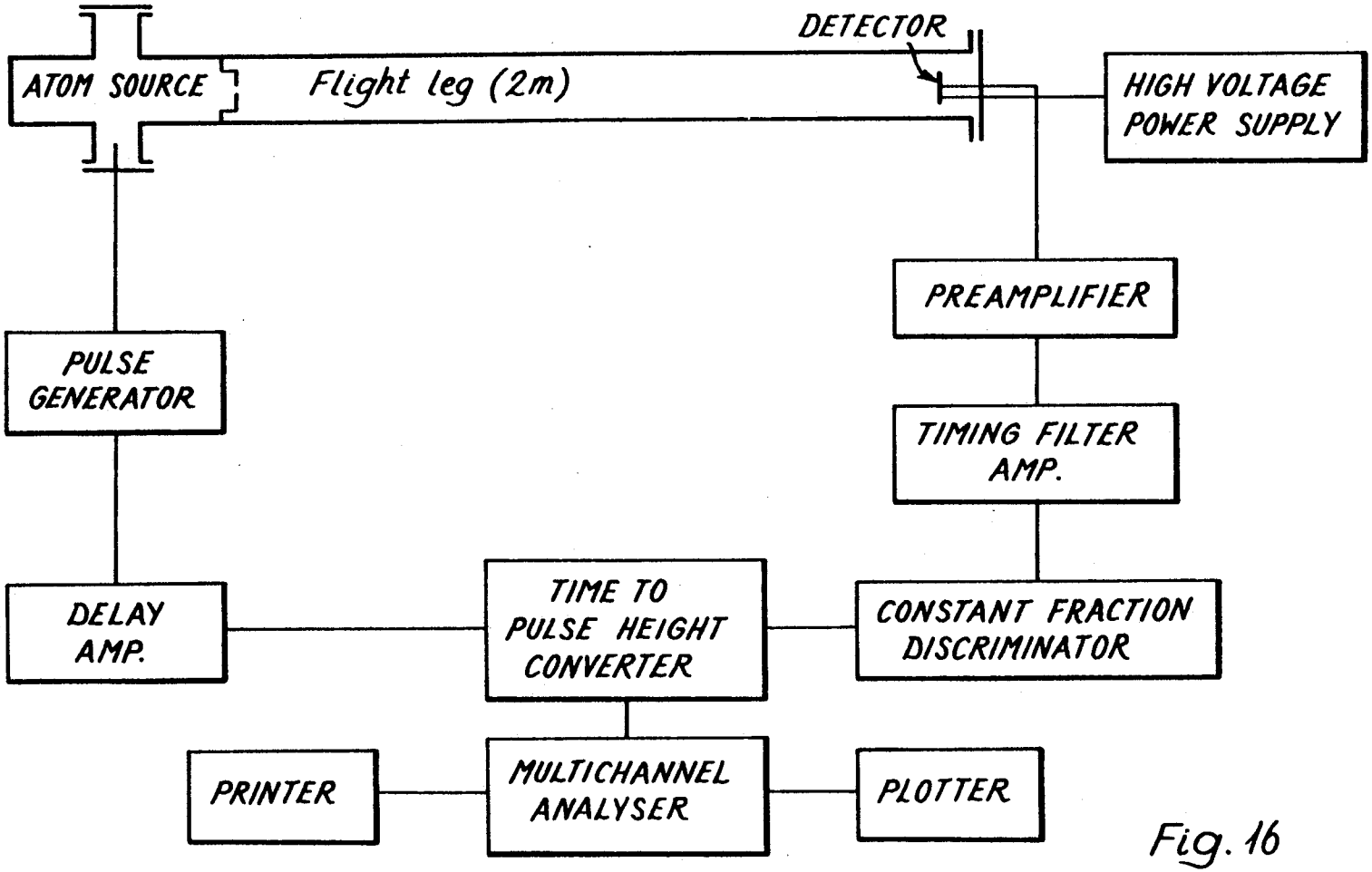
Figure 17:
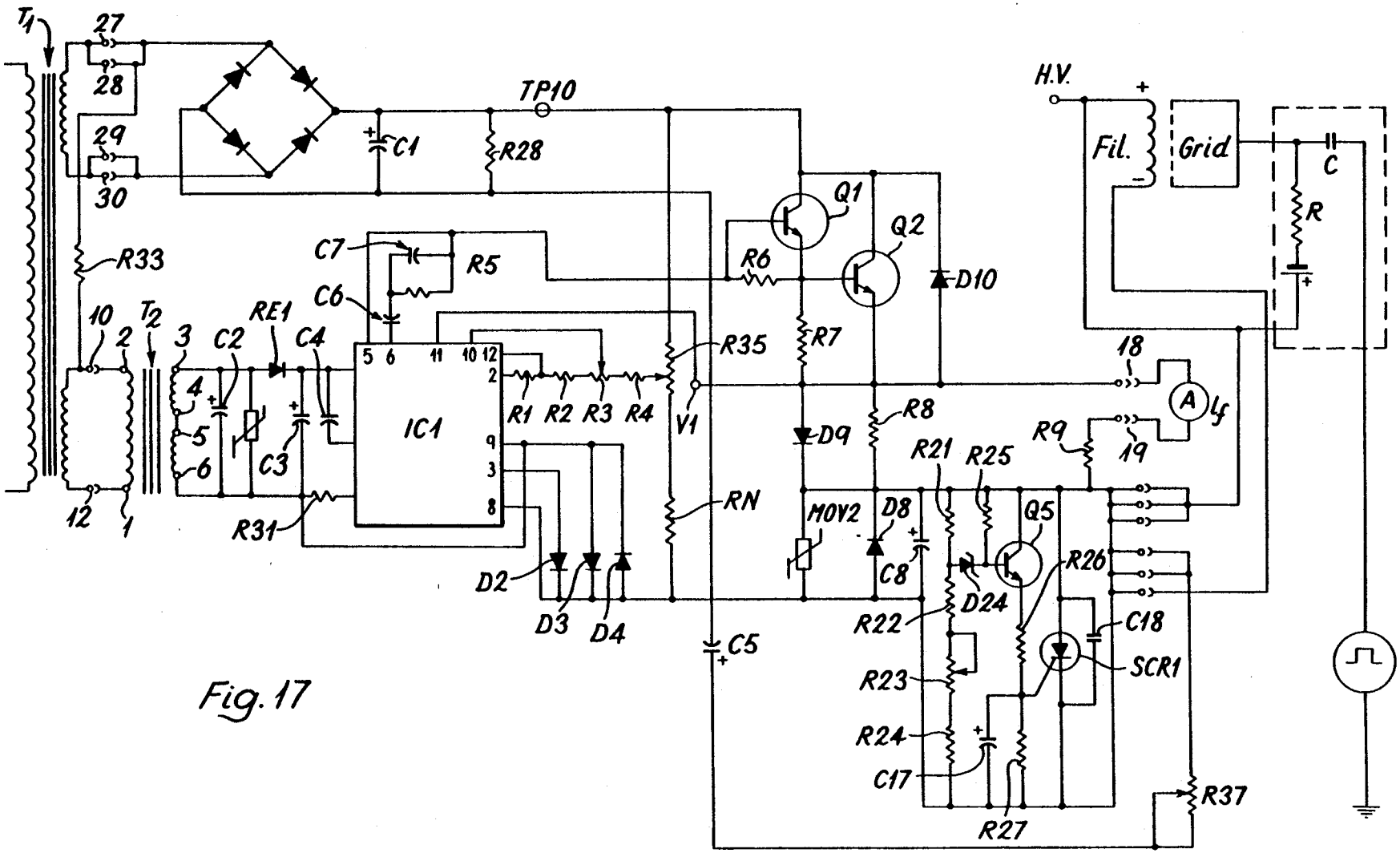
Figure 18:
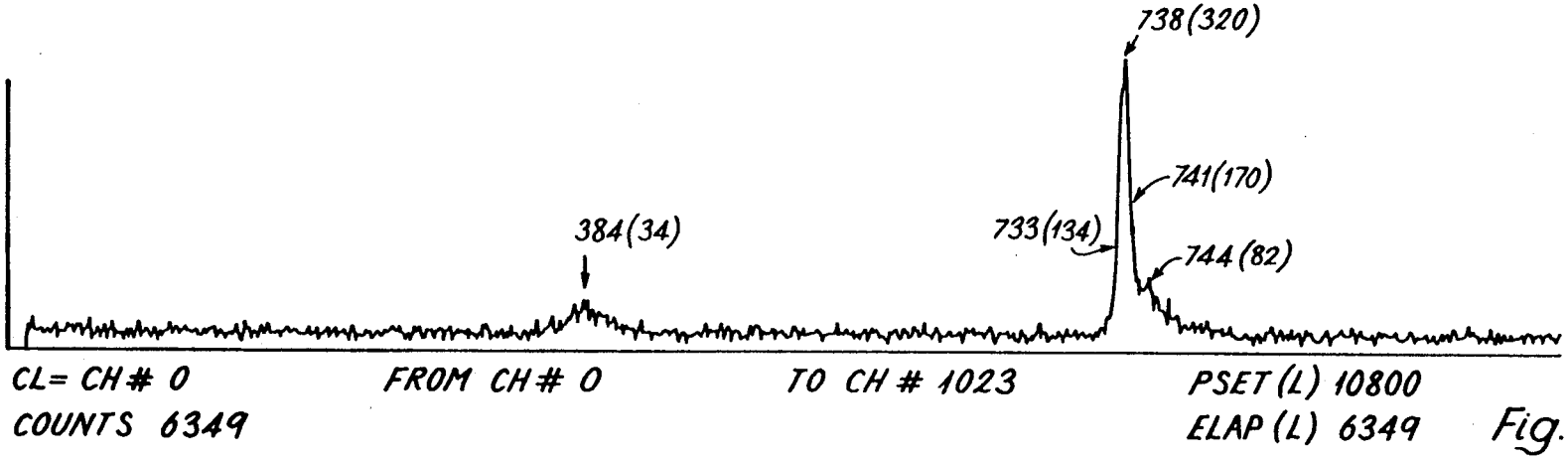
Figure 19:
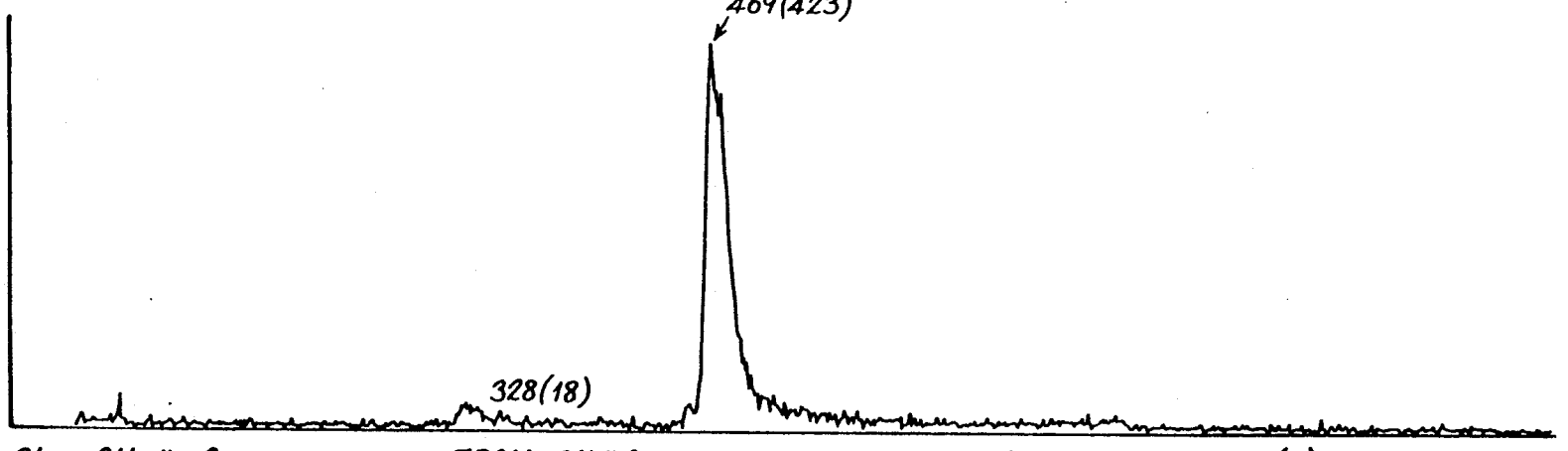
Figure 20:
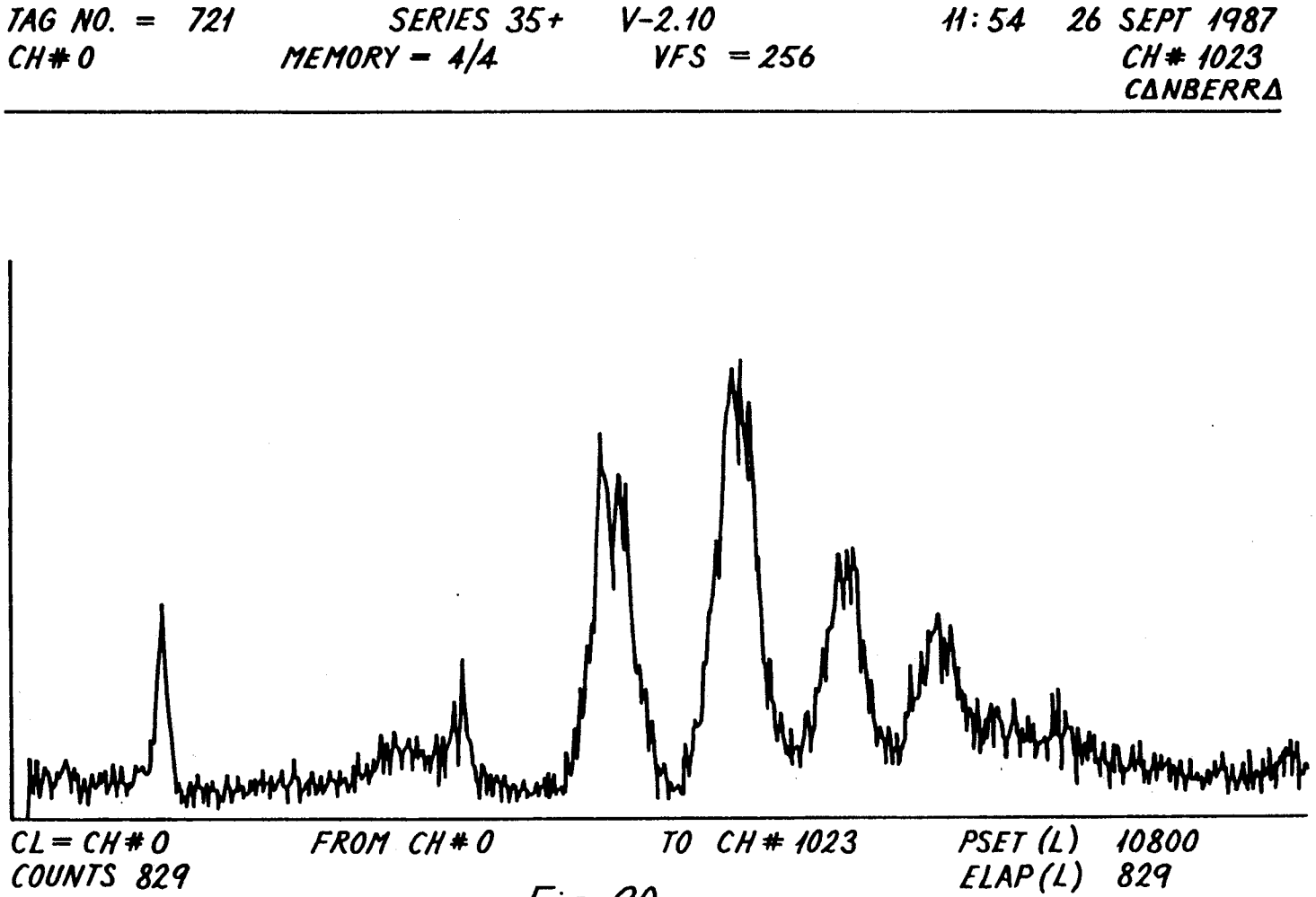

FIG. 4 is a graphical representation of the proportion of neutrals in an atom beam at different line pressures FIG. 5 is a plot showing how the secondary electron coefficient varies with beam energy FIG. 6 shows the variation of neutral current with differential pumping line pressure FIG. 7 is a schematic diagram showing the experimental arrangement for divergence measurement of the atom beam FIG. 8 is a current amplifier used in the measurement of atom beam divergence FIGS. 9 to 11 are oscilloscope traces FIG. 12A is a schematic diagram showing the parameters used in the calculation of current density and FIG. 12B shows parameters used in current distribution FIG. 13 s the result of a typical computation FIG. 14 is a schematic diagram showing the geometrical relationship used in the calculation of beam divergence FIG. 15 is a schematic diagram of the vacuum system of the time-of-flight facility FIG. 16 is a schematic diagram of the electronic system of the facility FIG. 17 is a modified control unit FIG. 18 is a typical example of the time-of-flight spectrum of a total beam FIG. 19 is a typical example of the time-of-flight spectrum of a neutral beam, and FIG. 20 is a fast atom scattering spectrum for argon atoms incident on a gold surface.

Figure 1:
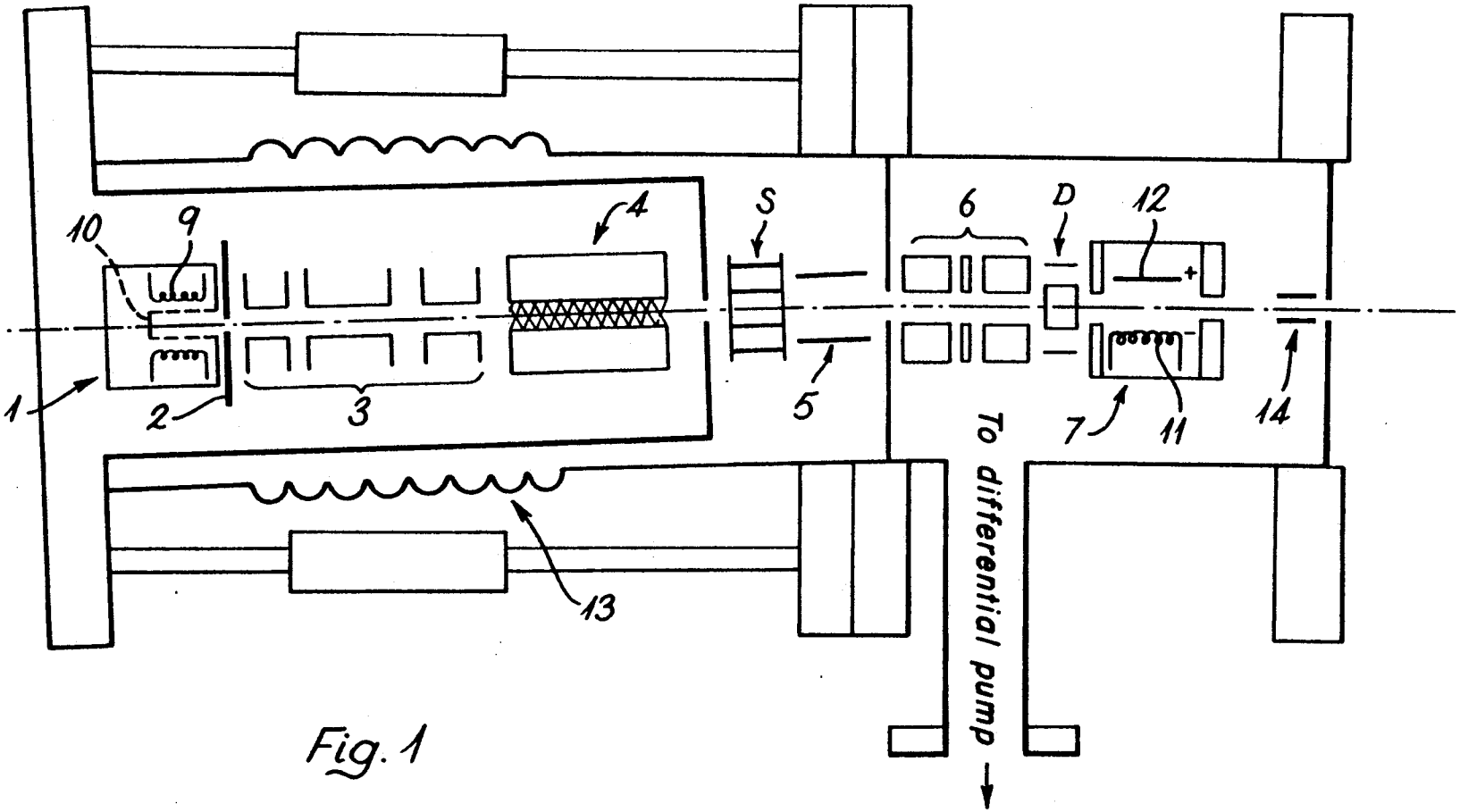
FIG. 1 is a schematic section of a pulsed atom source

Referring now to the drawings, the basic idea of pulsing is to generate ions only when a voltage pulse is applied. As shown in FIG. 1, ions are created by electron impact in an ionization cell 1. They are then extracted from the ionization cell by means of an extraction electrode 2 and focused immediately by an einzel lens 3. A Wien filter 4 then allows only one value of ion velocity to pass. Those ions emerging from the filter are subsequently deflected at an angle of about 5° from the previous axis by deflecting electrodes 5. This is necessary because neutrals created in that section of the gun may have a wide energy spread. This feature thus serves as a neutral dump. A Bruch telefocus lens 6 is then employed to focus the ions through a charge exchange cell 7. Such a lens allows one to include a long length charge exchange cell between the lens and a target without losing the focused beam. The region occupied by the lens is kept under good vacuum conditions, so that probability of charge exchange is minimized at this stage. The charge exchange cell is so designed that either a resonance or an electron capture charge exchange process can take place inside: this corresponds to a high or low neutral current mode. The exit aperture of the cell incorporates a set of deflection plates 8 which remove residual ions from the neutral beam and also may be used to scan the ion beam when the source operates in an ion mode.

The ion source includes a heated filament 9 and a grid 10. Gas is ionized by electron impact. This configuration is particularly suitable for the pulsing method, simple, and easy to be operated.

Optionally, the atom source may include a stigmator S to correct for astigmatism resulting from non-uniform field effects due to the Wien filter. The stigmator is positioned immediately after the filter element and consists of two quadruples displaced by 45° from one another. By application of suitable voltages to the quadruples from an external power supply, the direction of the correcting field may be adjusted and astigmatism eliminated before the beam enters the second lens system.

Optionally, also, scanning means may be provided for the atom beam. This comprises X and Y deflection plates D, positioned between the second lens element and the charge exchange cell. By application of a suitable voltage to the scanning plates, the ion beam may be displaced in a raster scan. The beam then passes through the charge exchange cell where a proportion is neutralized. Ions in the beam are then removed by the plates 14 at the exit aperture, giving a rastered neutral beam.

Figure 2:
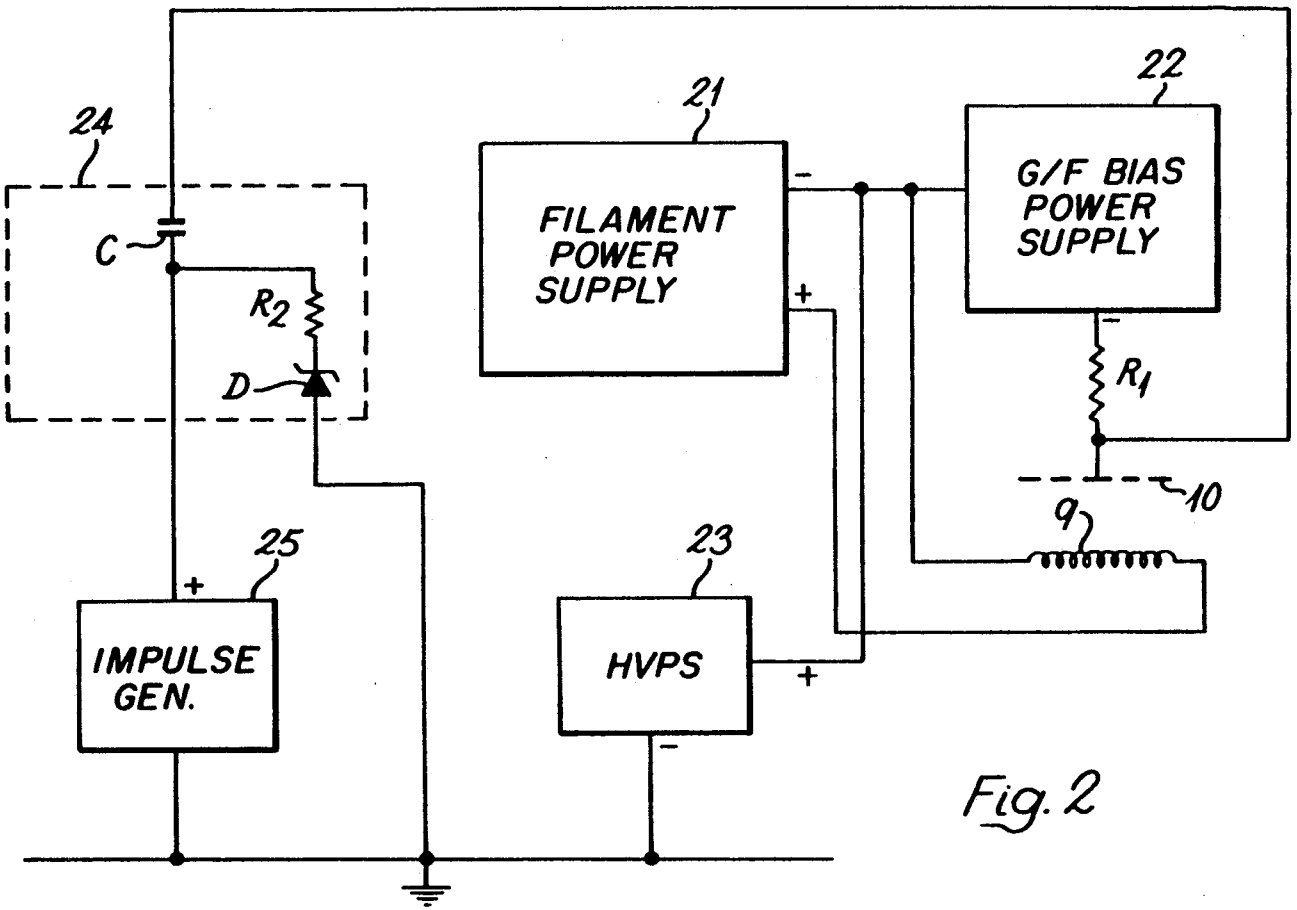
FIG. 2 is a block circuit diagram illustrating the method of pulsing the atom source of FIG. 1

Part of the control unit for the source is shown schematically in FIG. 2. It includes a filament power supply 21, a grid to filament bias voltage power supply 22, a high power voltage power supply 23, a high voltage isolation circuit 24 comprising a diode D, a resistor R2 and a capacitor C and a purpose-selected pulse or impulse generator 25. The filament 9 is heated by the filament power supply 21 and gives rise to stable thermionic electron emission. Because the energy of such electrons is much less than the ionization energy of any element of gas, no ions are produced and thus no atoms. However, if a voltage across the filament and grid is provided, the electrons will be accelerated and may obtain sufficient energy to ionize a gas atom if the voltage is higher than the threshold of the ionization energy. This voltage is pulsed through the high voltage isolation circuit 24. This simple circuit is designed to pass a pulse train having frequencies in the range of 10 kHz to 1 MHz without significant degradation of shape, while the values of the resistor R and capacitor C are so chosen that more than 90% of the voltage is dropped across the resistor. A grid to filament bias voltage is required here to pull back the energetic electrons when a pulse falls to its "ground" level. A zener diode D is included in the earthy side of the high voltage isolation circuit. This is to protect the pulse generator in case of capacitor breakdown.

It is very important to choose a suitable pulse generator. The general requirements are mentioned in FIG. 2. In order to produce a sufficient pulse of ions, the amplitude of the voltage pulse must be greater than 100 V, into a load of 50Ω. If a high current is not necessary, this voltage can be low provided that the voltage across the grid and filament is higher that the ionization potential of a gas atom. Pulse width is an important parameter in some applications such as time-of-flight measurements: the width determines the resolution of the system. Pulses with a width as small as 2ns can be obtained from impulse type generators. However, because capacitance effect could be important in the pulsing system employed using such a pulse generator, the width of the final pulse appearing across the grid may be ~18ns. Frequency of the output pulse train governs the collection coefficient of a time-of-flight system. Frequency as high as 1 MHz is good enough for most applications. Parameters such as pulse height, pulse width and frequency can be specified according to the specific application.

The second important part of the source is the charge exchange cell. In order to have effective neutralization, the cell is designed to be able to maintain pressure of about $10^{-3}$mbar two orders of magnitude higher than that of other parts of the system, with the exception of the ionization cell. Another feature of this charge exchange cell is that it contains a set of hot filaments 11 and a set of electrodes 12 which are located opposite one another and parallel to the trajectory of a beam, i.e. the axis of the cell. It is then possible to neutralize ions by an electron capture mechanism instead of resonance gas charge exchange. Since the neutralization probability by electron capture is low, the source operated with this mode can be expected to have only a small current. However, this may be enough for some of the applications such as fast atom scattering spectrometry where only one atom from each pulse is required. The advantage of operating in this mode is that it makes it much easier to pump down the gas flow in the source so that the specimen chamber pressure is easily kept in ultra high vacuum conditions which are important to many surface analyses and studies. This pulsed source may also be used to produce ion pulses by non operation of the charge exchange cell.

Another important feature of this source is that it can be easily switched to operate in DC conditions, i.e. to output continuous neutral current (NC mode), ion current (IC mode) or both (NIC mode). In the case of IC mode, beam scanning can be achieved by using the deflection plates 14. Therefore, it is possible to use this source in an ion scattering spectrometry where an electrostatic analyser is employed, in atom or ion depth profiling or in secondary ion mass spectrometry (SIMS) or Fast Atom SIMS applications. The nature of beam depends on the operation mode: when the charge exchange cell is filled with gas and the deflection voltage is off, or instead of filling gas, the filament and the electrode inside the cell are operated, output is both ion and atom, while if the deflection voltage is on, output is neutral. Without gas inside the cell, output is ion only. In any case, this function is also very important because it permits the use of the same source for surface treatment during the experiment.

In order to characterize the fast atom source, measurements have been carried out to determine the variation of neutral currents with specimen chamber pressure, the proportion of neutrals in the beam and the divergence of a beam, under various operating conditions.

It is necessary to know the relationship between neutral current and chamber pressure because it is important to maintain chamber vacuum as high as possible provided that enough neutral current can be obtained. In addition, the measurement of the neutral proportion of the beam can provide information of purity of a beam as well as of neutral production efficiency of the source.

Figure 3:
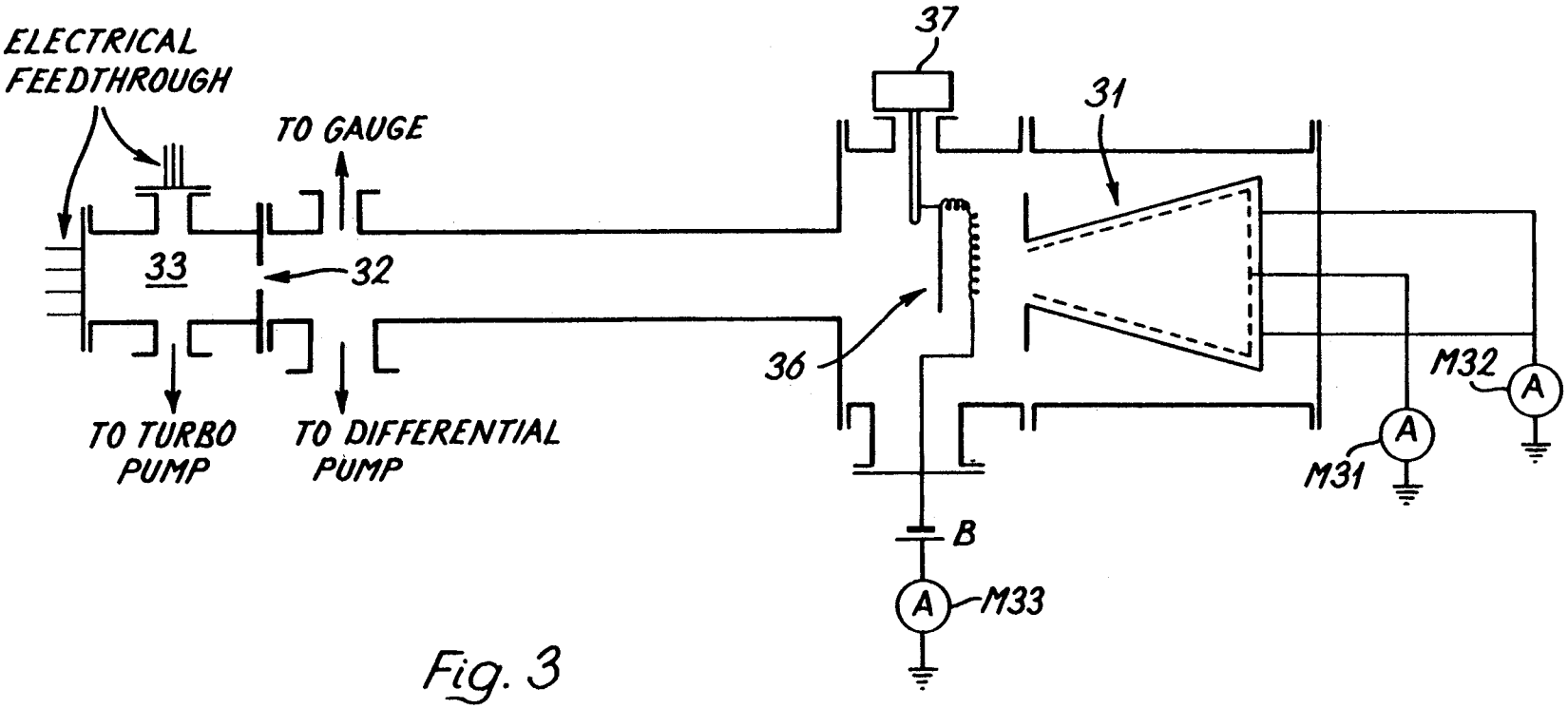
FIG. 3 is a schematic diagram of an experimental arrangement used for the measurement of the current characteristics of the atom source of FIG. 1

The experimental arrangement is shown schematically in FIG. 3. A Faraday cup 31 is mounted axially opposite the exit aperture 32 of the source 33. The cup is so designed that any secondary electrons created by incoming particles cannot escape from the cup. It is also prevented from picking up electrons outside by shielding. The current measured with a picoammeter M31 is the electron current required to neutralize charged particles collected in the cup. With this arrangement, it is therefore possible to measure ion fraction of a beam. A detection plate 36 attached to a manipulator 37 is placed in front of the entrance of the cup. With this, the atom flux may be determined by using the deflection plates of the source to remove the ion content in a beam. A 12-volt battery B is used to bias the detection plate so that it prevents secondary electrons from coming back to the plate. Before any measurement is made, the source is aligned on axis by adjusting the bellows 13 and focused so that any particle detected by the detection plate goes into the cup. Those not entering the cup will strike the shielding of the cup and thus give rise to a current reading on the monitoring picoammeter M32. Similarly, if the detection plate is not completely rotated away from the beam, a current will be recorded in a further picoammeter M33 Measurement has been made at eight different energies, corresponding to source high voltage range of 1 to 5 kV, of argon.

To obtain a set of measurements, firstly a value of the source voltage is fixed. Then, the leak valves (not shown) are open to allow argon gas to enter the source until pressure in the differential pumping line reaches a desired value. Subsequently, a neutral equivalent current $I_a$ can be obtained by using the detection plate with usage of the deflection plates of the source removing ions from the beam. For accuracy of the measurement the current is allowed to stabilize for several minutes. After this, the voltage to the deflection plates is turned off to allow the total beam to strike the detection plate and thus total beam equivalent current $I_t$ can be determined. Following this, the detection plate is rotated away from the beam by using the manipulator and the ion current in the beam is measured by monitoring the Faraday cup current $I_i$. The above procedure is then repeated for a range of pressures.

The proportion of neutrals in the beam can now be calculated from the following equation:

$$R = \frac{I_a}{I_i + I_a} \times 100\%$$

Several sets of results were processed and plotted and are shown in FIG. 4. As can be seen, within the range of experimental pressures the proportion of neutrals is less than 10%. It is also shown that this proportion varies with pressure and increases very slowly before the source pressure reaches certain values, for example, $Pd = 10^{-5}$ mbar. In terms of equivalent current, the maximum obtained for atom is −240 nA.

The variation of neutral current with pressure can also be derived from these results. First, the secondary electron emission coefficient $\gamma$ is determined in the following form:

$$\gamma = \frac{I_t - I_i - I_a}{I_t}$$

because the total current consists of three terms: i.e.

$$I_t = I_i + I_c \times \gamma + I_a$$

where $I_i$ is contributed by the electrons to neutralize ions. $I_i \times \gamma$, by secondary electron and $I_a$ equivalent current. Secondly, assuming that the secondary electron emission coefficient is the same as for ions i.e. equal to $\gamma$, the actual atom flux $I_a'$ is determined in the form of $I_a' = I_a/\gamma$. FIG. 5 shows a plot of $\gamma$ against ion energy (measured as a function of voltage $E_o$), whilst the variation in neutral current with pressure is shown in FIG. 6.

Measurements with helium have also been carried out and given results similar to those for argon.

Angular spread is an important parameter in atom scattering measurement since the energy of a scattered particle, in principle depends on the scattering angle, i.e the angle its trajectory makes with the direction of the incident particle. It has been found that conventional experimental methods cannot provide satisfactory information. For example, atom currents can easily sputter off a phosphor screen and thus do not give a homogeneous illuminated image, while a gold-coated window reveals different shapes of a cross beam section depending on the time taken in an etching process. For this source it is convenient to measure the divergence under different lens operating conditions without opening the vacuum chamber and replacing a detecting or recording device.

A simple apparatus has thus been designed for this measurement and provided some important information of the atom source. The apparatus is illustrated schematically in FIG. 7. A thin metal wire 71 of diameter of 0.1 mm is placed ~24 cm away from the exit aperture of the source. It is mounted in a holder 72 that is controlled by a micro-adjustable specimen stage, and is electrically insulated from it. It is however electrically connected to an input of a current amplifier 73, whose circuitry is shown in detail in FIG. 8. The output of the amplifier is connected to the $\gamma$-input of an analogue storage oscilloscope 74. If there are atoms striking the wire, secondary electrons are generated and the electron currents are amplified and recorded in the oscilloscope. Since the detected current is very small, of the order of nanoamperes, an FET amplifier 82 is used in the input stage of the amplifier. Furthermore, since the gain of the amplifier is quite high, it is important to screen and earth it properly.

In order to allow the wire to cut across an atom beam, the wire is moved horizontally by adjusting the specimen stage outside the vacuum. This movement is converted to voltage through a potentiometer 75 powered by a power supply 76 and the signal is input to the X-input of the oscilloscope. The movement recorded on the screen of the oscilloscope can be calibrated precisely by referring to the actual movement showing in the micrometer of the specimen stage.

To measure the divergence, a detected current distribution is first recorded. After setting up the source operating in normal conditions, the wire is scanned across the beam 77 by moving the specimen stage 78 manually. The distribution is often very broad and may be badly distorted under these lens conditions. Sometimes distributions with double peaks can occur. To obtain the best focusing conditions, it is necessary to follow the operating guide rules provided by the source manufacturer and adjust the lens voltages every time. FIG. 9 is a typical detected current distribution and is in the form of a Gaussian distribution. It is found that only one set of lens voltages can give rise to the best focused beam of all different energies of the atom. However, in general the higher the energy of the atom, the less the beam is diverged. This is shown in FIG. 11. Another important finding is presented in FIG. 10, which shows two distributions corresponding to total beam and neutral beam respectively. It can be seen that there is a displacement between two peaks.

With the distributions like that shown in FIG. 9, the true beam divergence may be calculated by means of a simple mathematical procedure with the value of the distribution's full width at half maximum. However, in order to calculate the divergence more accurately, a current density distribution is required. In fact, referring to FIG. 12B, a current density can be determined according to the following form:

$$n(\chi) = \frac{I(\chi)}{d \times y\,(\text{area})}$$

where I is the current detected and d the diameter of the wire as shown in FIG. 12A. Since the recorded current distribution is in the Gaussian form, I can be determined as below:

$$I = H_p \times exp\,(-F^2/2_x^2)$$

where $H_p$ is the peak high, F full width at half maximum (FWHM); they can be measured from the recorded current distribution. FIG. 13 is an example of this computation result; the inner curve is a simulated current distribution while the outer the current density distribution.

Referring to the geometric relationship illustrated in FIG. 14, the angle $\theta$ representing the beam divergence is determined by the following relationship:

$$\theta = tg^{-1}\left(\frac{FWHM/2}{L}\right)$$

According to the design of the ion optic system of the source, a beam cross disc should locate at ~1 inch away from the exit aperture so that L is equal to a term of (24 cm−1 in). Also, in this calculation the conventional idea of using FWHM in such beam divergence estimation is applied.

The neutral production efficiency of the source is rather low and the neutral current is small, for example, about 10nA at chamber pressure of $\sim 10^{-6}$torr. However, with our time-of-flight system, it is possible to operate with the source working in the very low current mode because of the high transmission coefficient of such a system. One of the features of this source is that it can provide a pure neutral beam. This eliminates the possibility of confusion of atom scattering with ion scattering. The most impressive features of this source is its very small beam diameter and its divergence which is around 1°. This small beam diameter which may be around 350 μm facilitating the sampling of interesting areas of a target. Both features ensure a very good resolution when used in a Fast Atom Scattering Spectrometer (FASS).

Experiments have also been carried out to measure the energy distribution of fast atoms and ions. In order to measure this energy for neutral particles, a time-of-flight technique has been employed in which the time taken for a particle to travel freely over a known distance is measured accurately. The apparatus for this is shown in FIG. 15 and comprises a pumping system, analysis chamber and flight tube. The pumping system, which comprises a rotary pump 150, valve 151, traps 152, 153, pirani gauge 154 and diffusion pump 155 with rough line 156, maintains a pressure of less than $10^{-9}$ torr. The analysis chamber includes an atom source 157, a flight tube 158 provided with an ion gauge 159 and detector mounting port 160. In order to obtain good vacuum conditions within the analysis chamber, the source is pumped by a turbo-molecular differential pumping stage comprising a turbo pump 161 with an isolation valve 162 and ion gauge 163. The basic electronic system designed to accomplish the time-of-flight measurements is shown in FIG. 16 and includes nanosecond pulsing, detection and data acquisition circuitry.

In order to produce a neutral pulse for the time-of-flight system, it is necessary to modify the source control unit that only operates for the source giving continuous neutral current. The circuit of the modified control unit is shown in detail in FIG. 17. The major part of it is a power supply to the filament of the source, with a filament overvoltage protection circuit. The integrated circuit of the IC1 provides a function of stabilizing the filament current. The feedback of this IC is now provided by $V_1$ instead of using electron emission current. This feedback is necessary because otherwise voltage to the filament will be increased until it is tripped over. With this part of the circuit, the filament may be heated and gives rise to a stable thermionic electron emission. Because the energy of such electrons is much less than the ionization energy of any element of gas, no ion is produced and thus no atoms. However if a voltage across the filament and grid is provided, the electrons will be accelerated and thus obtain enough energy to ionize the gas atom, if the voltage is higher than the threshold of the ionization energy. This voltage is provided with a pulse transmitted through the high voltage isolation circuit enclosed with the dashed lines. This simple RC circuit is required to allow a pulse train having a frequency in the range of 10 kHz–1 MHz without degrading its shape whilst the values of the resistor R and capacitor C are so chosen that more than 90% of the voltage is dropped across the resistor.

In the measurement of the energy distributions of both the neutral and total beams, stop apertures have been placed inside the flight tube to prevent particles scattered inside the tube from reaching the detector. FIG. 18 is a typical time-of-flight energy distribution of the total beam. The main spectral peak corresponds to Ar and the smaller peak to $Ar^{++}$. The energy spread is ~1% at the incident particle energy. FIG. 19 is the corresponding spectrum for the neutral beam.

Experiments reveal that without the Wien filter residual gas peaks also occur, indicating am impure beam.

Improvements may be made in the method of production of monoenergetic fast atoms by introducing both a neutral dump and a Wien velocity filter into the source.

The FASS technique may also be used to obtain information on the characteristics of surfaces. An example of scattering of argon atoms from a contaminated gold surface using the FASS is shown in FIG. 20.

As with low energy ion scattering spectrometry, our fast atom scattering spectrometer will provide surface chemical composition information by analysis of the spectrum of the scattered atom. But this study may be focused on how to obtain a high resolution spectra and thus involves the elimination of spurious charge effects.

Due to basic scattering mechanisms shadowing effects may be observed in the spectra. This can be used to study the orientations of the surface atom, giving unique information on atomic arrangement in the surface. By changing the incident angle of the primary beam amplitudes of spectral peaks may vary or even some peaks may disappear. Analysis of these results can thus provide information on the surface structure.

In experiments with low energy ion scattering spectrometry, it has been found that the relationship between scattered ion yield and incident ion energy varies with the combination of the surface of a target and an incident ion. Bonding information may be obtained by a study of characteristic curves of scattering ion yield.

By operating the time to amplitude converter in coincidence mode, it is possible to record sputtered species in the multi-channel analyser. From the area of the recorded distribution and time taken, sputter rate may be calculated. Mass analysis may also be available by incorporating a mass filter into the flight tube.

By applying the time-of-flight system to a variety of materials such as metals, semiconductors and insulators, and using either ion or atoms as bombarding particles, differences of chemical damages caused by these two projectiles may be detected. This is of major interest too, for example, the semiconductor industry where ion surface modifications are becoming more and more important.

We claim:

1. A source of atomic or molecular particles comprising:

a source of ionized particles;

means for removing a beam of said ionized particles from said source;

focusing means for focusing said beam of particles to form a focused beam of particles;

filter means for selecting particles in said focused beam having a predetermined velocity; and charge exchange means for permitting neutralization of charge on said ionized particles, wherein said charge exchange means maintains a pressure at least two orders of magnitude higher than that of adjacent parts of the system.

2. A source of atomic or molecular particles as claimed in claim 1, wherein said source produces a pulsed beam of ionized particles.

3. A source of atomic or molecular particles as claimed in claim 2, wherein said filter means includes a neutral dump comprising a Wien filter which allows only one value of ion velocity to pass at a given time.

4. A source of atomic or molecular particles as claimed in claim 3 further comprising means for deflecting the ions emerging from the Wien filter.

5. A source of atomic or molecular particles as claimed in either claim 1 or 2, wherein said source includes an ionization cell which creates ions in said beam of ionized particles by electron impact.

6. A source of atomic or molecular particles as claimed in claim 5 further comprising an extraction electrode for extracting said ions from the ionization cell.

7. A source of atomic or molecular particles as claimed in claim 6 wherein said focusing means comprises an einzel lens for focusing said ions after extraction from the ionization cell.

8. A source of atomic or molecular particles as claimed in claim 7, wherein said filter means includes a neutral dump comprising a Wien filter which allows only one value of ion velocity to pass at a given time.

9. A source of atomic or molecular particles as claimed in claim 8 further comprising means for deflecting the ions emerging from the Wien filter.

10. A source of atomic or molecular particles as claimed in claim 9, wherein said deflecting means deflects the ions emerging from the Wien filter at an angle of about 5° from the previous.

11. A source of atomic or molecular particles as claimed in claim 6, wherein said filter means includes a neutral dump comprising a Wien filter which allows only one value of ion velocity to pass at a given time.

12. A source of atomic or molecular particles as claimed in claim 13 further comprising means for deflecting the ions emerging from the Wien filter.

13. A source of atomic or molecular particles as claimed in claim 5, wherein said filter means includes a neutral dump comprising a Wien filter which allows only one value of ion density to pass at a given time.

14. A source of atomic or molecular particles as claimed in claim 11 further comprising means for deflecting the ions emerging from the Wien filter.

15. A source of atomic or molecular particles as claimed in claim 1 further comprising a Bruch telefocus lens to focus ions in said focused beam which have passed said filter means, through said charge exchange means.

16. A source of atomic or molecular particles as claimed in claim 15, wherein a region occupied by the Bruch telefocus lens is held under high vacuum conditions in order to minimize the probability of charge exchange therein.

17. A source of atomic or molecular particles as claimed in claim 1, wherein the charge exchange means performs one of a resonance or an electron capture charge exchange process therein.

18. A source of atomic or molecular particles as claimed in claim 1, wherein said pressure maintained by said charge exchange means is about $10^{-3}$ mbar.

19. A source of atomic or molecular particles as claimed in claim 1, wherein the charge exchange means includes a set of heatable filaments and a set of electrodes which are located opposite one another and substantially parallel to a trajectory of a beam to neutralize ions by an electron capture mechanism.

20. A source of atomic or molecular particles as claimed in claim 1, further comprising an exit aperture incorporating a set of deflection plates to remove residual ions from the beam which has been neutralized by said charge exchange means.

21. A source of atomic or molecular particles as claimed in claim 1, further comprising an exit aperture incorporating a set of deflection plates to scan an ion beam.

22. A source of atomic or molecular particles as claimed in claim 1, wherein a source of ionized particles includes a heated filament and a grid.

23. A source of atomic or molecular particles as claimed in claim 1, further comprising stigmator means adjacent said focusing means, to correct for astigmatism resulting from non-uniform field effects.

24. A source of atomic or molecular particles as claimed in claim 1, wherein the stigmator means comprises a pair of quadruples displaced by 45° from one another.

25. A source of atomic or molecular particles as claimed in claim 1, further comprising scanning means to generate a raster format beam.

* * * * *